US005756430A

United States Patent [19]

Zielinski

[11] Patent Number: 5,756,430

[45] Date of Patent: May 26, 1998

[54] MIST OIL LUBRICANT

[75] Inventor: James Zielinski, Somerset, N.J.

[73] Assignee: Exxon Chemical Patents Inc, Linden, N.J.

[21] Appl. No.: 855,047

[22] Filed: May 13, 1997

Related U.S. Application Data

[63] Continuation of Ser. No. 617,009, Mar. 18, 1996, abandoned.

[51] Int. Cl.[6] ..... C10M 169/04; C10M 105/36; C10M 143/06

[52] U.S. Cl. ..... 508/275; 508/279; 508/282; 508/442; 508/481; 508/482; 508/496; 508/499; 508/563; 508/584; 508/591; 585/3; 585/12

[58] Field of Search ..... 508/275, 280, 508/442, 481, 482, 591, 279, 282, 496, 499, 563, 584; 583/3, 12

[56] References Cited

U.S. PATENT DOCUMENTS

| | | |
|---|---|---|
| 3,805,918 | 4/1974 | Altgelt et al. . |
| 3,855,135 | 12/1974 | Newingham et al. . |
| 3,860,522 | 1/1975 | Fischer et al. . |
| 4,111,821 | 9/1978 | Lazarus et al. . |
| 4,589,990 | 5/1986 | Zehler et al. . |
| 4,601,840 | 7/1986 | Zehler et al. . |

FOREIGN PATENT DOCUMENTS

| | | |
|---|---|---|
| 0013504 | 1/1977 | Japan . |
| 1099450 | 1/1968 | United Kingdom . |
| 1333882 | 5/1986 | United Kingdom . |

OTHER PUBLICATIONS

Energy Resources Technology Conference and Exhibition, Houston, TX (Jan. 1966), "Aerosol Aspects of Oil Mist Lubrication—Reclassification and Deposition of Oil Mist in Bearings" Abdus Shamin and Charles F. Kettleborough.

*Primary Examiner*—Margaret Medley
*Attorney, Agent, or Firm*—John J. Mahon

[57] ABSTRACT

Mist oil lubricants are disclosed based on polycarboxylic acid esters as the base oil which have added 1 to 5% of polyisobutylene Mn 400–2500 as stray mist suppressants.

10 Claims, No Drawings

MIST OIL LUBRICANT

This is a continuation of application Ser. No. 08,617,009, filed Mar. 18, 1996, now abandoned.

This invention relates to mist oil lubricating compositions based upon synthetic ester base oils.

A mist oil lubricating composition distributes fine droplets of oil compositions in aerosol form to the areas of various machine elements to be lubricated.

Oil mists are generated in a number of ways. A typical system employs a device consisting of a reservoir opened to a venturi. Compressed gas is blown through the venturi, lubricant is drawn from the reservoir by the suction thus created and the lubricant is mechanically fractured by the turbulence of the air stream into tiny droplets. Downstream the mixture impinges against baffles where large droplets that are transported with difficulty are coalesced and returned to the reservoir. Many oil particles form an aerosol with particle diameters in the range of 0.1 to 20 microns.

Control of the oil droplet particle size is an important aspect of oil mist lubricating systems. If the particles are too large, the droplets will readily lubricate a bearing or other surface but will have a tendency to condense within the feeder pipelines. If particle size is too small and velocity too low, coalescence will not occur and stray mist will create a serious problem. Fine aerosol is difficult to coalesce by reclassification and excessive stray mist is produced giving a smoky effect to the atmosphere.

Therefore, stray mist is the most troublesome feature of mist lubrication systems. The lubricated machine element is normally open to the atmosphere, and mist which is not reclassified, escapes into the atmosphere where it may form a potential hazard to health and safety due to deposition on environmental services and respiration.

Oil mist lubricating systems are disclosed, for example, in British Patent 1099450 (1966) which discloses the use of high molecular weight polymers to control stray mist. Preferred are copolymers of vinyl acetate, alkyl fumarate esters and N-vinyl pyrrolidone having number average molecular weights of at least 100,000. Polyisobutenes having number average molecular weights of at least 10,000, for example, 44,000, are also disclosed. These stray mist suppressant additives are used in oil mist lubricating compositions based on petroleum mineral oils.

U.S. Pat. No. 3,805,918 (1974) issued to Altgelt et al. also discloses the use of relatively high molecular weight polymers to suppress the formation of unwanted stray mist. In particular, this reference discloses the use of olefinic copolymers having a viscosity average molecular weight at or greater than 20,000. In particular, this reference discloses at column 7, line 25, that polyisobutylene is more effective as a stray mist suppressant when used at higher molecular weights, that is, at molecular weights of 50,000 to 800,000.

U.S. Pat. No. 4,589,990 (1986) issued to Zehler et al. discloses improved mist lubricant compositions which contain certain synthetic ester base oils, e.g., polyol esters, trimellitate or polymeric fatty acid esters, which have added amounts of polyisobutylene having an average molecular weight from 25,000 to 300,000 to improve the stray mist characteristics of the oil.

The present invention is based on discovery that mist oil lubricating compositions based on alkyl polycarboxylic acid esters as the base oils will have their stray mist characteristics significantly improved through the use of certain amounts of relatively low molecular weight polyisobutylene.

In accordance with the present invention there has been discovered a lubricating composition suitable for mist lubrication which exhibits reduced stray mist characteristics and which is prepared by combining, and which consists essentially of, by weight:

a) 90 to 95% of base stock ester oil being an alkyl ester of a polycarboxylic acid or a mixture of such esters, the alkyl being straight chain or branched and having 5 to 18 carbon atoms, the oil having a viscosity of 10–150 cSt at 40° C.

b) 3 to 5% of a total amount of one or more special purpose additives (other than polyisobutylene) selected from the group consisting of rust inhibitors, corrosion inhibitors, anti-wear agents, antioxidants, demulsifiers, anti-foam agents and extreme pressure agents, and c) as a stray mist suppressant 1 to 5% of a polyisobutylene having a Mn molecular weight from about 400 to 2500.

Another embodiment of this invention is a mist lubricating process where a mist of lubricant is generated in air under pressure and pneumatically transported to a metal surface to be lubricated, coalesced into larger droplets and deposited on the metal surface, using the foregoing composition as the lubricant.

Suitable base stock ester oils generally comprise $C_5$ to $C_{18}$ straight or branched chain alkyl esters of aromatic or aliphatic polycarboxylic acids, the oil having a viscosity of 10 to 150 cSt. at 40° C. Preferred are esters of aromatic dicarboxylic acids having 8 to 14 carbon atoms, aliphatic dicarboxylic acids having 4 to 12 carbon atoms and cycloaliphatic dicarboxylic acids having 8 to 12 carbon atoms. Suitable acids include phthalic acid, adipic acid, trimellitic and pyromellitic acid, maleic acid, azelic acid suberic acid, sebasic acid, fumaric acid, linoleic acid dimer, malonic acid, alkyl succinic acid, alkenyl succinic acid and the like.

The preferred base stock ester oils for use in this invention are mixtures of branched chain tridecyl phthalate and tridecyl adipate wherein the mixture is such that about 80–85% by weight of the mist lubricant is ditridecyl phthalate and about 10–15% is ditridecyl adipate, more preferably about 81% of ditridecyl phthalate and about 15% ditridecyl adipate, which has a viscosity of about 68 cSt. at 40° C.

The preferred composition of the present invention is one in which the other additives comprise triphenyl phosphorothionate as an antiwear agent, benzotriazole and alkylated benzotriazole rust inhibitors, phenothiazine and dinonyl diphenyl amine antioxidants, and oxyalkylated (70% propylene oxide, 38% ethylene oxide) amylphenol demulsifier.

The special purpose additives used in the compositions of this invention are well known in the art and, typically, there will be about 0.02 to 2.0% by weight of each additive, the total amount of such additives being 3 to 5% by weight.

Antioxidants include the phenolic antioxidants and arylamines, but phenothiazine and dinonyl diphenylamine are particularly preferred.

Anti-wear agents and extreme pressure agents include sulfurized fatty acid or fatty acid esters, organopolysulfides, organophosphorous derivatives such as amine phosphates and dialkylphosphates. Triphenyl phosphorothionate is particularly preferred.

Rust and corrosion inhibitors include dibasic acids, quinolines and quinones, ester and amide derivatives of alkenyl succinic anhydrides, metal alkyl sulfonates and the like. Preferred is benzotriazole and alkylated benzotriazole and alkylated amino methylene benzotriazoles, the alkyl being $C_1$–$C_{20}$.

Typical demulsifiers include alkoxyalkylated alkyl phenols, monohydric alcohols, alkylene glycols and the like.

A preferred demulsifier is an oxyalkylated (70% propylene oxide, 30% ethylene oxide) amylphenol resin.

Anti-foam agents include silicone oils, acrylates and the like, such as polydimethyl siloxane.

The stray mist suppressant additive of the compositions of the present invention is polyisobutylene of number average molecular weight (Mn) 400–2500 (measured by gel permeation chromatography) and it may be present in amounts ranging from about 1 to 5% by weight of the overall mist lubricant composition. Particularly, preferred are oils which contain 1% by weight of polyisobutylene of Mn 1300 or 3% by weight of polyisobutylene of Mn 950.

The term "polyisobutylene" as used herein refers to a mixture of poly-n-butenes and polyisobutylene which normally results from the polymerization of $C_4$ olefins and generally will have a molecular weight of about Mn 400 to about Mn 2500.

A preferred polyisobutylene polymer for use in this invention is a mixture of polybutenes and polyisobutylene prepared from a $C_4$ olefin refinery stream containing about 6 wt. % to 50 wt. % isobutylene with the balance a mixture of butene (cis- and trans-) isobutylene and less than 1 wt. % butadiene. Particularly, preferred is a polymer prepared from a $C_4$ stream composed of 6–45 wt. % isobutylene, 25–35 wt. % saturated butenes and 15–50 wt. % 1- and 2-butenes. The polymer is prepared by Lewis acid catalysis.

The oils of this invention, when generated as a mist dispersion of oil droplets in air have substantially reduced amounts of sub-micrometer particles, that is, droplet particles less than 0.4 micron AED and particles in the 0.4 to 0.7 micron AED range. AED is Aerodynamic Equivalent Diameter defined as the diameter of the unit density sphere that has the same terminal settling velocity due to gravity as the particle in quiescent air.

The droplet particle size measurement techniques used in the Examples below were published by A. Shamim and C. F. Kettleborough of Texas AVM University, Department of Mechanical Engineering, College Station, Texas in an article entitled "Aerosol Aspects of Oil Mist Lubrication—Reclassification and Deposition in Bearings" for the Energy Resources Technology Conference and Exhibition, Houston, Tex., January, 1996.

The invention is further illustrated by the following examples. All percentages are by weight.

EXAMPLES

A commercially available mist lubricant Base Oil was prepared composed of the following:

| | |
|---|---|
| Ditridecyl phthalate* | 81.50% |
| Ditridecyl adipate* | 14.27% |
| Triphenyl phosphorothionate | 2.00% |
| Dinonyl diphenylamine | 1.60% |
| Phenothiazine | 0.40% |
| Isononyl amino methylene benzotriazole | 0.15% |
| Benzotriazole | 0.05% |
| Oxyalkylated amylphenol resin (70% propylene oxide, 30% ethylene oxide) | 0.03% |
| | 100.00% |

*The blended esters have a viscosity of 68 cSt. at 40° C.

The oils 1–7 of this invention were prepared by blending 95–99% of the base oil with varying amounts of polyisobutylene as listed below:

The oils 1–7 of this invention were prepared by blending 95–99% of the base oil with varying amounts of polyisobutylene as listed below:

| Oil | Base Oil, % | Polyisobutylene, % and Mn |
|---|---|---|
| 1 | 99 | 1% Mn 1300 |
| 2 | 99 | 1% Mn 2225 |
| 3 | 97 | 3% Mn 1300 |
| 4 | 95 | 5% Mn 1300 |
| 5 | 99 | 1% Mn 950 |
| 6 | 97 | 3% Mn 950 |
| 7 | 95 | 5% Mn 950 |

Experimental procedure: The Base Oil and each of the 7 oils of the invention were evaluated for stray mist characteristics and in particular sub-micrometer droplet particle size. Minimization of the amount of these very small particles is important since these are capable of penetrating the more sensitive parts of the inner lung.

A 40 BI vortex type oil mist generator has been used in all the tests. The oil valve was fully open and the air bypass valve was fully closed. The oil in the reservoir was maintained at 24° C. temperature. The oil level in the generator was kept constant for all the tests. The configuration of the tubes and pipes in the oil mist supply system were maintained identical for all the tests. The particle mass-size distributions were measured after generation, before the test bearing and after the test bearing (stray mist). An inertial cascade impactor along with a dilution chamber have been used in these tests. Three tests were run for each test setup. A total of 45 tests were run resulting in 450 data points. It has been shown that the mist type reclassifier causes negligible change in the mass-size distribution of oil mist. So the droplet mass-size distribution of the generated oil mist was measured after the pressurized oil mist flowed through a mist type reclassifier. This simplified the sampling process. For these tests the test bearing (77.5 mm pitch diameter) was operated at 2400 rpm. The mist type reclassifier no. 501 (0.09 SCFM flow rate) was used to lubricate the test bearing.

The stray mist characteristics of each of the seven oils listed above were measured by comparing their particle size distribution to that of the Base Oil, which did not contain any polyisobutylene stray mist suppressant. For each of oils 1–7 a substantial reduction in particles in the 0.0 to 0.4 micron and 0.4 to 0.7 micron range was observed, when compared with the particle size distribution for the Base Oil. An Andersen 1 ACFM (Actual Cubic Feet per Minute) non-viable cascade impactor was used to measure the droplet mass-size distribution of the oil mist. When a vacuum pump sucks aerosol through the cascade impactor, the airborne particles are collected on various stages of the cascade impactor according to the AED of the particle.

TABLE 1

Relative number of particles found in various size ranges in the stray mist for the eight test oils. For an oil, the number of particles found in a size range is shown as a percentage of the number of particles found in the 0.4 to 0.7 μm AED size range for the Base Oil.

| Size Ranges in μm AED | Number of particles found in the stray mist for oils as percentage of the number of particles found in the 0.4 to 0.7 μm AED size range for the Base Oil. | | | | | | | |
|---|---|---|---|---|---|---|---|---|
| | Base Oil | Oil 1 | Oil 2 | Oil 3 | Oil 4 | Oil 5 | Oil 6 | Oil 7 |
| 0.0 to 0.4 | 97.49 | 0.00 | 0.00 | 0.00 | 0.00 | 75.82 | 0.00 | 0.00 |
| 0.4 to 0.7 | 100.00 | 50.00 | 37.50 | 13.02 | 7.29 | 71.88 | 50.00 | 28.65 |
| 0.7 to 1.1 | 47.07 | 43.51 | 31.02 | 18.66 | 15.10 | 49.45 | 42.32 | 33.28 |

TABLE 1-continued

Relative number of particles found in various size ranges in the stray mist for the eight test oils. For an oil, the number of particles found in a size range is shown as a percentage of the number of particles found in the 0.4 to 0.7 μm AED size range for the Base Oil.

| Size Ranges in μm AED | Number of particles found in the stray mist for oils as percentage of the number of particles found in the 0.4 to 0.7 μm AED size range for the Base Oil. | | | | | | | |
|---|---|---|---|---|---|---|---|---|
| | Base Oil | Oil 1 | Oil 2 | Oil 3 | Oil 4 | Oil 5 | Oil 6 | Oil 7 |
| 1.1 to 2.1 | 12.76 | 11.74 | 10.92 | 8.78 | 7.74 | 12.25 | 10.79 | 10.56 |
| 2.1 to 3.3 | 0.79 | 0.79 | 0.75 | 0.77 | 0.72 | 1.01 | 0.66 | 0.70 |
| 3.3 to 4.7 | 0.11 | 0.08 | 0.07 | 0.09 | 0.08 | 0.14 | 0.03 | 0.06 |
| 4.7 to 5.8 | 0.00 | 0.01 | 0.01 | 0.01 | 0.01 | 0.02 | 0.00 | 0.01 |
| 5.8 to 9.0 | 0.00 | 0.00 | 0.00 | 0.00 | 0.00 | 0.00 | 0.00 | 0.00 |
| 9.0 & above | 0.00 | 0.00 | 0.00 | 0.00 | 0.00 | 0.00 | 0.00 | 0.00 |

Note: The Aerodynamic Equivalent Diameter (AED) is the diameter of the unit density (1 g/cm$^3$) sphere that has the same terminal settling velocity due to gravity as the particle in quiescent air. For the lubricating oils tested, the AED is approximately same as the actual particle diameter.

What is claimed is:

1. A lubricant composition suitable for mist lubrication consisting essentially of, by weight a) 90 to 95% of a base stock ester oil being an alkyl ester of a polycarboxylic acid selected from the group consisting of aromatic dicarboxylic acids having 8 to 14 carbon atoms, aliphatic dicarboxylic acids having 4 to 12 carbon atoms and cycloaliphatic dicarboxylic acids having 8 to 12 carbon atoms, the alkyl being straight or branched chain C5 to C18 alkyl, the ester oil having a viscosity of 10–150 cSt at 40° C.;

b) 3 to 5% of special purpose additive selected from the group consisting of rust inhibitors, corrosion inhibitors, anti-wear agents, anti-foam agents, antioxidants, demulsifiers, extreme pressure agents and mixtures of same, and c) as a stray mist suppressant, 1 to 5% of a polyisobutlene having a Mn of from about 400 to 2500.

2. The composition of claim 1 wherein the polyisobutylene has an Mn of 1300 or 950.

3. The composition of claim 1 wherein the polyisobutylene has an Mn of 1300 and is present in an amount of about 1%.

4. The composition of claim 1 wherein the polyisobutylene has an Mn of 950 and is present in an amount of 3%.

5. The composition of claim 1 wherein the ester oil is a mixture of about 80–85% by weight of branched chain tridecyl phthalate and 10–15% of tridecyl adipate.

6. The composition of claim 1, 2, 3, 4 or 5 wherein the special purpose additive comprises phenothiazine, benzotriazole, oxyalkylated arylphenol resin, triphenyl phosphorothionate, dinonyl diphenylamine and alkylated benzotriazole.

7. In a lubrication process where a mist of lubricant is generated in air under pressure and pneumatically transported to a metal surface to be lubricated, coalesced into larger droplets and deposited on said metal surface, the improvement which comprises using as the lubricant, the composition of claim 1.

8. The lubricant composition of claim 1 or claim 5 which is prepared by combining said a), b) and c) ingredients.

9. The composition of claim 6 which is prepared by combining said a), b) and c) ingredients.

10. The process of claim 7 wherein the ester oil is a mixture of about 80–85% by weight of branched chain tridecyl phthalate and 10–15% by weight branched chain tridecyl adipate.

* * * * *

UNITED STATES PATENT AND TRADEMARK OFFICE

CERTIFICATE OF CORRECTION

PATENT NO. : 5,756,430

DATED : May 26, 1998

INVENTOR(S) : James Zielinski

It is certified that error appears in the above-indentified patent and that said Letters Patent is hereby corrected as shown below:

Column 6, claim 1 (c), line 1, delete "polyisobutlene" and insert -- polyisobutylene --.

Signed and Sealed this

Eighteenth Day of August, 1998

Bruce Lehman

*Attest:*

BRUCE LEHMAN

*Attesting Officer*

*Commissioner of Patents and Trademarks*